US009320310B1

(12) United States Patent
Judge et al.

(10) Patent No.: US 9,320,310 B1
(45) **Date of Patent: *Apr. 26, 2016**

(54) CLOTHING GARMENT WITH COMBINATION HAT AND HOOD

(71) Applicants: Scott A. Judge, Northlake, IL (US); Frank A. Judge, Somonaujk, IL (US)

(72) Inventors: Scott A. Judge, Northlake, IL (US); Frank A. Judge, Somonaujk, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/462,542

(22) Filed: Aug. 18, 2014

Related U.S. Application Data

(63) Continuation-in-part of application No. 13/730,951, filed on Dec. 29, 2012, now Pat. No. 8,806,664.

(51) Int. Cl.
*A42B 1/04* (2006.01)
*A42B 1/18* (2006.01)

(52) U.S. Cl.
CPC ... *A42B 1/04* (2013.01); *A42B 1/18* (2013.01); *A41D 2200/20* (2013.01)

(58) Field of Classification Search
CPC ..... A41D 2200/20; A41D 3/02; A41D 3/06; A41D 3/04; A41D 3/08; A42B 1/046; A42B 1/205; A42B 1/24; A42B 1/18; A42B 1/247
USPC ..... 2/84, 85, 86, 87, 88, 93, 98, 202, 108, 2/69, 171.1, 209.11, 209.12, 209.13, 2/175.6, 195, 5, 10
See application file for complete search history.

(56) References Cited

U.S. PATENT DOCUMENTS

| | | | | |
|---|---|---|---|---|
| 1,980,394 | A * | 11/1934 | Falcon | 2/98 |
| 2,547,931 | A * | 4/1951 | De Grazia | 2/84 |
| 5,713,077 | A * | 2/1998 | Humbrecht | 2/173 |
| 7,302,710 | B2 * | 12/2007 | Thomas et al. | 2/84 |
| 7,380,286 | B1 * | 6/2008 | Bryant, Sr. | 2/84 |
| 8,438,665 | B2 * | 5/2013 | Roemer et al. | 2/84 |
| 8,806,664 | B1 * | 8/2014 | Judge et al. | 2/84 |

* cited by examiner

*Primary Examiner* — Tejash Patel
(74) *Attorney, Agent, or Firm* — Kelly & Krause, L.P.; W. Dennis Drehkoff

(57) ABSTRACT

A garment comprising a cover having a lower edge attached substantially to the circumference of a neck of the garment and an upper edge that is attached to a hat. The cover having an opening for the wearer's face has a secure fitting around the wearer's head when the hat is worn by the wearer, thereby preventing wind and cold from reaching the wearer's neck and sides of the face and head and improving the wearer's peripheral vision.

10 Claims, 3 Drawing Sheets

CLOTHING GARMENT WITH COMBINATION HAT AND HOOD

This is a continuation-in-part application of Ser. No. 13/730,951, filed on Dec. 12, 2012 which is incorporated herein by reference. This application claims the benefits of the earlier filed application.

BACKGROUND

1. Field of the Invention

The present invention relates to the field of hooded garments, and particularly to a garment having and integrated hood and hat combined therein.

2. Brief Description of the Prior Art

Various outdoor clothing worn in cool or cold weather may have hoods attached onto the garment for protecting the wearer's head, neck and face from the elements. The outdoor apparel may be jackets, coats, sweaters and sweatshirts. The hood may be sewn into the garment around the neck opening or may be removable. This allows the user to cover the head and neck when exposed to the elements or remove the hood when not needed.

Some individuals wear hats for keeping warm, for example, stretch hats, hats with bills, hats with ear coverings, etc. The hats are worn as a preference, but in some instances, hats may be required, for example, hats with bills for blocking the sun or hardhats required to be worn in construction areas for protection. Some wear hats and hooded clothing. In this regard, the hat usually interferes with the fitting of the hood around the wearer's head, neck and face. FIG. 1 shows a representation of hardhat on an individual with a hood covering the head, neck and sides of the face. The hat causes gaps of the hood on either side of the face because of its placement on the top of the hood. The gaps allow wind to enter the sides of the face and move around the wearer's neck and head obviating any warmness created by the hood. The gaps may require the wearing of additional face and neck warming articles, for example, face masks, scarfs, turtlenecks and other garments. The wearing of additional garments may be uncomfortable, inconvenient and unsafe when worn in construction areas. There is a need for a garment with a combined hat and hood wherein the wearer has benefits of wearing the hat and hood with in a warm, secure manner.

BRIEF SUMMARY OF THE INVENTION

One embodiment of the present invention is a garment comprising a body having a neck opening and sleeves that fits over the torso and head of the wearer. A cover having a lower edge and circumference in which a substantial portion of the circumference is attached to the neck of the garment. The cover has an opening for the wearer's head, face and an upper edge. The upper edge of the cover is attached to a head covering. The cover has a sufficient height to wrap around or cover the wearer's neck, sides of the face and sides of the head but not the top of the head. The wearer's chin is exposed when the head covering is worn. A head covering is attached to the upper edge of the cover and covers the top of the wearer's head. The head covering has an upper edge that substantially covers the wearer's neck, sides of the head and both sides of the wearer's face to substantially eliminate gapping of the garment on the sides of the wearer's face. The head covering may be attached by sewing onto the cover, by fastener connectors and by hook and loop connectors, etc. The head covering may be a hat that is stretchable, for example a knit hat, a billed hat, for example, a baseball hat or a hard hat for wearing in construction areas. The cover with the attached head covering is more comfortable to wear than a hood and with hat placed on top of the hood. This embodiment of the present invention provides a cover dimensioned so that there is no bunching or clumping of it when a head covering is attached to it and the hat is placed on top of the wearer's head. Further, the cover allows for better peripheral vision since the sides of a hood are not bunched on the sides of the wearer's face blocking peripheral vision. The hat can be removed and, since it is attached to the cover, hangs on the cover against the wearer's shoulders and back of the wearer's neck behind the head.

Another embodiment of the present invention is a combination hood and hat wherein a lower edge of a lower partial hood is connected to a neck opening of a garment, the lower partial hood also having an upper edge, an upper partial hood is connected to the upper edge of the lower partial hood, wherein the upper partial hood is a hat. The combined hood and hat garment has advantages for the wearer over that of a completed hood covering the head and hat placed on top.

Another embodiment of the present invention is a combination hood and hat wherein a stretchable material, for example, elastic, is placed within a channel running from the upper edge of the front of the cover to the lower edge for securing the front sides of the cover in order to prevent gaps from forming on its front sides adjacent the wearer's face. The structure of the cover or hood may or may not include drawstrings. The stretchable material is preferably used without drawstrings while keeping the front sides of the cover close to the wearer's face thereby eliminating gaps in the cover.

DETAILED DESCRIPTION

Figure 1:
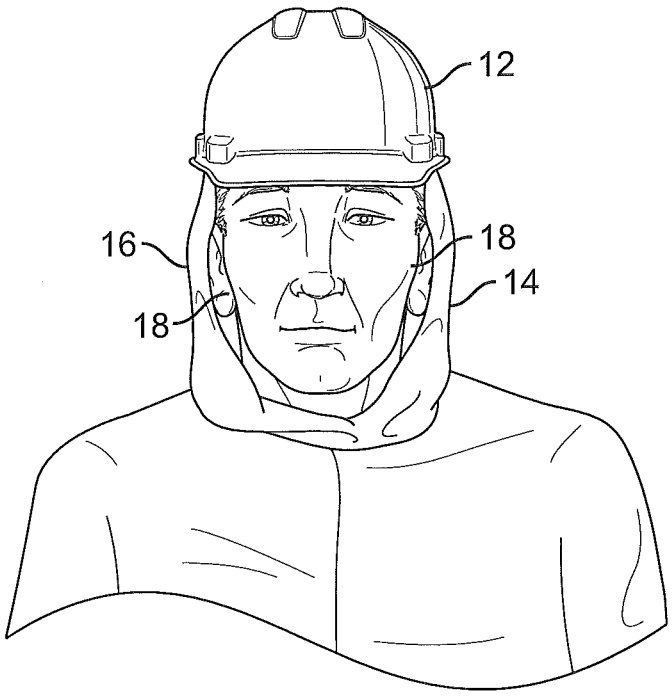
FIG. 1 (Prior Art)
FIG. 1 is a front view of a prior art garment with a hat being worn on the top of a hood by the wearer showing gaps on the sides of the hood adjacent the wearer's face.

FIG. 1 illustrates a front view of a prior art hooded sweatshirt with the wearer having a hard hat 12 positioned on his head. Hard hat 12 causes an uneven fit and gaps or bunching of sides 14 of hood 16 on the sides 18 of the wearer's face. This allows wind and cold air to move around the wearer's neck and head which may cause the wearer to wear additional protection in cold weather, a scarf, face cover, etc.

Figure 4:
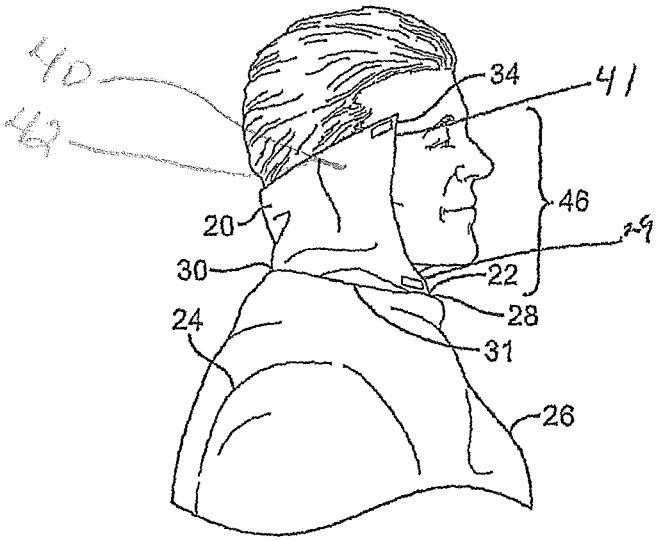
FIG. 4 illustrates a side view of one embodiment of the invention showing a cover having sufficient height to substantially cover the wearer's neck, both sides of the face and head.

FIG. 4 shows cover 20 attached to neck 22 of garment 10 having arms 24 and body 26 that fit over the torso of the wearer. Cover 20 has lower edge 28 and circumference 30 wherein a substantial portion 32 of circumference 30 being attached to neck 22. Cover 20 has opening 32 for the wearer's face and upper edge 34 for attaching a head cover 36, generally shown as knit hat 38 in FIG. 5, in one preferred embodiment. Cover has sides 23 and 25 that fit close to the sides of the wearer's face. Head cover 36 is attached to cover 20 by any suitable connector 40 that may be sewn onto cover 20, the upper edge 34. Connectors 40 may be snap fasteners 42 or hook and loop fasteners 44. Corresponding connectors are placed in the appropriate locations on head cover 36. Cover 20 has a sufficient height 46 to substantially cover the wearer's neck, both sides of the face and sides of the head of the wearer.

Figure 2:
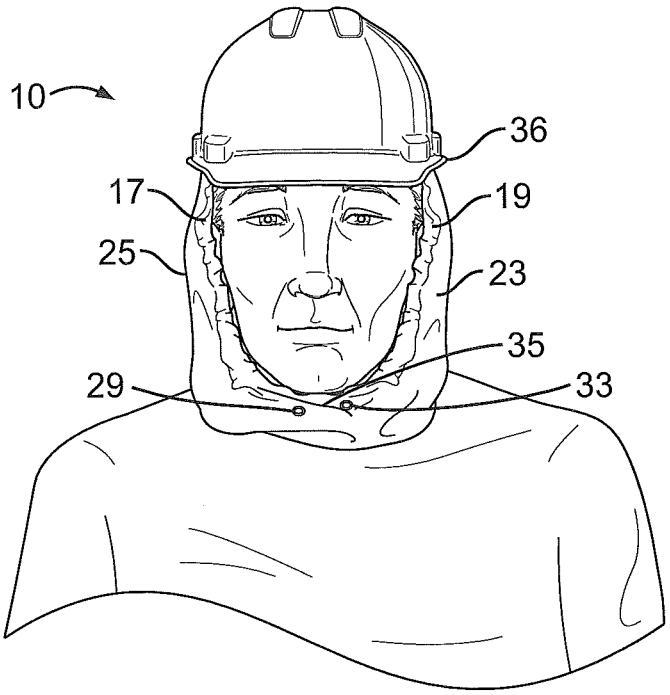
FIG. 2 illustrates front view of one embodiment of the invention showing a hat attached to cover that eliminates gaps around the wearer's neck, both sides of the face and head with no drawstring attached to the cover.

FIG. 2 illustrates one embodiment of the invention with channels 17 on either side of the front of cover 20 containing a strip of stretchable material 19, for example, elastic, that fits around sides 18 of the wearer's face for a secure fit. With strip 19, there are no gaps or uneven fitting around the wearer's face. No drawstrings are required. Lower edge 28 of cover 20 and adjacent circumference 30 have first arm 29 and opposed second arm 33 on opposed separate edges 39A and 39B of the garment respectively below and adjacent lower edge 28 forming a design 35 adjacent the neck of the wearer. The design preferably is "V" shaped and keeps cover 20 and elastic strip 19 spaced from the wearer in a comfortable arrangement. Each leg of the "V" design has one arm and edge opposed to each other. The edges forming the arms of the "V". This arrangement causes no discomfort because cover 20 and first arm 29 and second arm 33 retain elastic 19 substantially away from the wearer's neck. Elastic strip 19 within channel 17 is anchored at position 41 adjacent upper edge 34 of cover 20 and in arms 29 and 33 adjacent lower edge 28. This arrangement is not to be intended to be unduly limited for other designs may function in the same way for separating opposed arms for receiving stretchable material.

Figure 3:
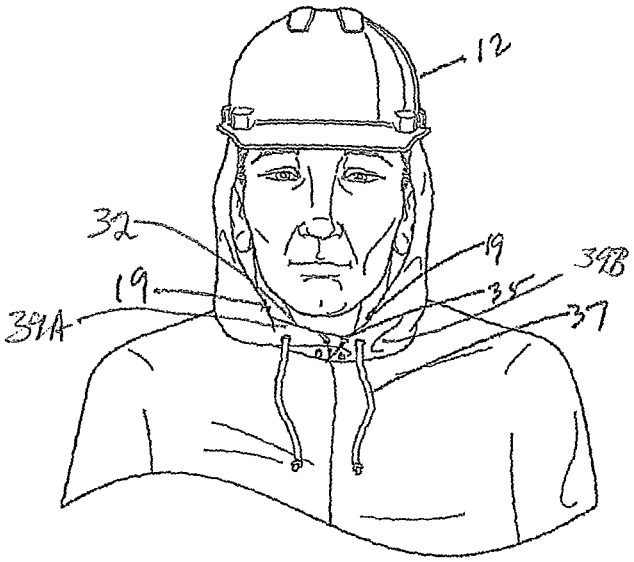
FIG. 3 illustrates a front view of a prior art garment and hat worn on the top of the hood of the wearer showing gaps on the sides of the hood adjacent the wearer's face with untied drawstrings attached to the hood.

FIG. 3 illustrates another embodiment of the present invention wherein drawstrings 37 are optionally utilized by being connected to stretchable material or elastic 19 in channel 17. The arms on opposed edges 39A and 39B with design 35 position elastic strip 19 substantially away from the wearer's neck even when drawstrings 37 are tied as shown in FIG. 6.

Figure 5:
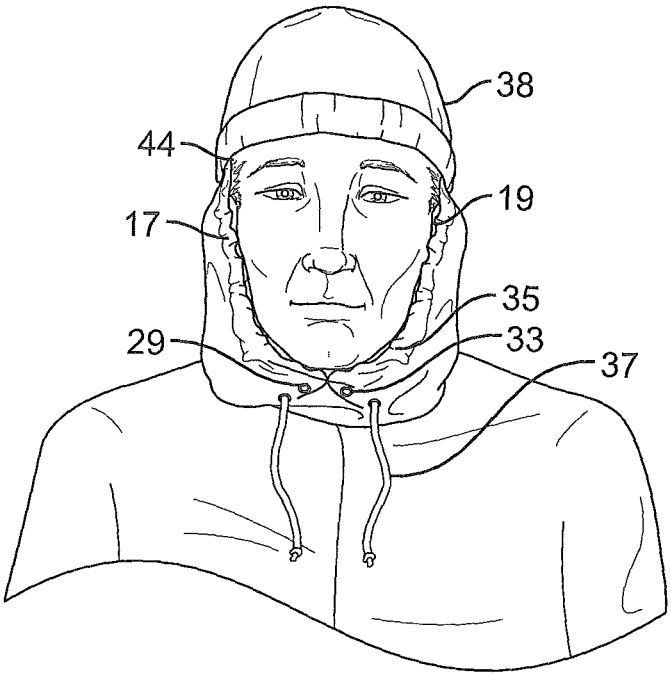
FIG. 5 illustrates a front view of one embodiment of the invention showing a knit hat on the wearer's head attached to the cover with no gaps showing on the sides of cover adjacent the owner's face with untied drawstrings.

With respect to FIG. 5, knit hat 38 is shown in a front view on the wearer's head. Knit hat 38 is attached to upper edge 34 of cover 20 by hook and loop fasteners 44. Knit hat 38 fits closely to the wearer's head offering warmth and protection from wind.

Figure 6:
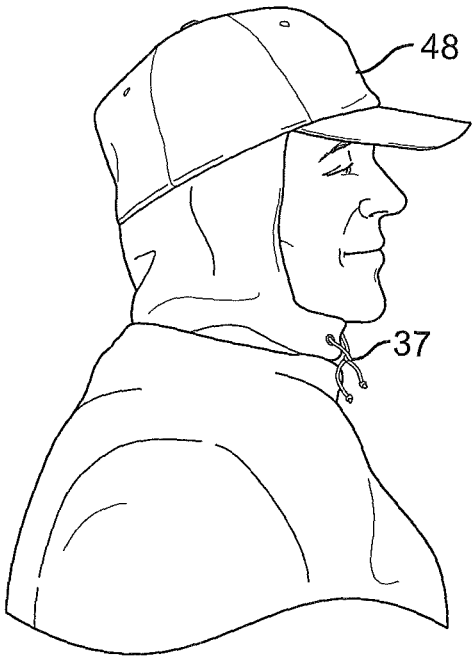
FIG. 6 illustrates a side view of one embodiment of the invention showing a baseball hat attached to the cover on the wearer's head with drawstrings tied.

FIG. 6 is a side view of billed hat 48 attached to cover 20 on the wearer's head. Billed hat 48 is shown to fit securely on the wearer's head while sides 23 and 25 of cover 20 fit securely around the wearer's face.

Conventional methods are utilized for patterning and construction the body of the garment.

The hat and hood of the present invention provide a secure fit on the wearer's head without gapping allowing for a close fit to the wearer's face. More than one type of hat can be attached, for example, a knit hat, hard hat, and a billed hat. Cover 20, which is sufficiently high to cover the wearer's neck, both sides of the face and sides of the head can be connected to a hat by hook and loop fasteners, snap fasteners, and be sewing.

The present invention has been described in terms of specific embodiments incorporating details to facilitate understanding the principles of the construction and operations of the invention. Such reference herein to specific embodiments and details thereof is not intended to limit the scope of the claims appended hereto. It will be apparent to those skilled in the art that modifications may be made in the embodiment chosen for illustration without departing from the spirit and scope of the invention.

What is claimed is:

1. A garment comprising:

a garment body having a neck opening and sleeves;

a cover having a lower edge and circumference, a substantial portion of the circumference being attached to the neck opening of the garment, the cover having an opening for the wearer's face, exposing the wearer's chin when the head covering is worn and an upper edge that substantially covers the wearer's neck, sides of the head and both sides of the wearer's face to substantially eliminate gapping of the garment on the sides of the wearer's face, and a channel running from an upper edge of the cover to a lower edge, the lower edge having first and second separated opposed arms for receiving the channels a stretchable material inside the channels for securing the cover to the sides of the wearer's face and being secured in the first and second opposed arms and a head covering attached to the upper edge.

2. The garment according to claim 1 wherein the cover has a sufficient height to substantially cover the wearer's neck, both sides of face and sides of the head.

3. The garment according to claim 1 wherein the head covering is attached to the upper edge of the cover by suitable connectors.

4. The garment according to claim 3 wherein the head covering is attached by sewing the head cover to the garment.

5. The garment according to claim 3 wherein the head covering is attached to the garment by snap fasteners.

6. The garment according to claim 3 wherein the head covering is attached to the garment by hook and loop fasteners.

7. The garment according to claim 1 wherein the head covering is a knit hat.

8. The garment according to claim 1 wherein the head covering is a billed hat.

9. The garment according to claim 1 wherein the head covering is a hard hat.

10. The garment according to claim 1 wherein drawstrings are attached to the stretchable material at the lower edge of the cover.

* * * * *